United States Patent [19]

Gajda

[11] Patent Number: 5,057,635

[45] Date of Patent: Oct. 15, 1991

[54] PROCESS FOR ISOMERIZING OLEFINS IN GASOLINE STREAMS

[75] Inventor: Gregory J. Gajda, East White Plains, N.Y.

[73] Assignee: UOP, Des Plaines, Ill.

[21] Appl. No.: 477,016

[22] Filed: Feb. 8, 1990

[51] Int. Cl.[5] ..... C07C 5/03; C07C 5/23; C07C 5/22

[52] U.S. Cl. ..... 585/259; 585/324; 585/329; 585/667; 585/671

[58] Field of Search ..... 585/259, 324, 329, 671, 585/667

[56] References Cited

U.S. PATENT DOCUMENTS

| | | | |
|---|---|---|---|
| 2,778,863 | 1/1957 | Maisel et al. | 260/674 |
| 3,236,909 | 2/1966 | Winnick | 260/683.2 |
| 3,470,085 | 9/1969 | Parker | 208/143 |
| 3,556,983 | 1/1971 | Kronig et al. | 208/37 |
| 3,636,125 | 1/1972 | Hoppstock | 260/683.2 |
| 3,702,291 | 11/1972 | Jacquin et al. | 208/57 |
| 3,751,502 | 8/1973 | Hayes | 260/668 A |
| 4,324,940 | 4/1982 | Dessau | 585/466 |
| 4,753,720 | 6/1988 | Morrison | 208/136 |
| 4,803,185 | 3/1988 | Miller et al. | 208/14 |
| 4,869,805 | 9/1989 | Lok et al. | 585/666 |

*Primary Examiner*—Curtis R. Davis

*Attorney, Agent, or Firm*—Thomas K. McBride; John F. Spears, Jr.; Richard E. Conser

[57] ABSTRACT

An improved process is disclosed for the isomerization of olefins in gasoline streams using a medium-pore molecular-sieve catalyst. The process features high yields of $C_5+$ isomerized product and avoids conversion of highly branched paraffins to equilibrium values.

18 Claims, No Drawings

PROCESS FOR ISOMERIZING OLEFINS IN GASOLINE STREAMS

BACKGROUND OF THE INVENTION

1. Field of the Invention

This invention relates to an improved process for the conversion of hydrocarbons, and more specifically for the catalytic isomerization of olefins in gasoline streams.

2. General Background

The widespread removal of lead antiknock additive from gasoline and the rising fuel-quantity demands of high-performance internal-combustion engines are increasing the need for "octane," or knock resistance, in the gasoline pool. Petroleum refiners have relied on a variety of options to upgrade the gasoline pool, including improved catalysts and processes for catalytic naphtha. The low-cost options for gasoline upgrading have been largely exploited, however, and refiners need new technology to address future gasoline-octane requirements.

Gasoline from catalytic cracking necessarily is a major target of octane-improvement efforts, as it typically amounts to 30 to 40% of the gasoline pool. Efforts to improve the cracking catalyst and process have resulted principally in increased gasoline aromatics content and reduction of low-octane components in the middle-boiling range. There is limited leverage to alter the cracking reaction to increase gasoline octane, however. The paraffin component has a higher-than-equilibrium ratio of isoparaffins to normal paraffins, and thus a higher octane than currently could be obtained by isomerization. The olefin component of the cracked gasoline has an equilibrium ratio of branched to unbranched olefins, and this can be changed only marginally in the cracking reaction.

A process for isomerizing olefins in catalytically cracked gasoline thus has considerable potential for improving the octane of the gasoline pool, but must address several problems. The process must not effect substantial isomerization of paraffins, in order to avoid changing the already-high ratio of isoparaffins to normal paraffins. The process should operate at relatively low temperature where the equilibrium ratio of branched to unbranched isomers is more favorable and by-products are minimized. An effective process also should solve the problem of highly unsaturated hydrocarbons in the feed such as acetylenes and dienes which could polymerize and foul the catalyst, thus requiring higher temperature to maintain catalyst activity and reducing catalyst life.

RELATED ART

Processes for the isomerization of olefinic hydrocarbons, including feedstocks in the gasoline range, are known in the art. U.S. Pat. No. 3,236,909 (Winnick) teaches isomerization of mono-olefins with a catalyst containing an acidic zeolite which has been neutralized with a buffered acidic solution to avoid polymer formation from tertiary olefins. U.S. Pat. No. 3,636,125 (Hoppstock) discloses a process using a specific molecular sieve to isomerize branched-chain 1-olefins to branched-chain 2-olefins. U.S. Pat. No. 3,751,502 (Hayes et al.) discloses the isomerization of mono-olefins using a catalyst comprising crystalline aluminosilicate in an alumna carrier. U.S. Pat. No. 4,324,940 (Dessau) teaches isomerization of smaller olefins having an effective critical dimension of 6.8 angstroms with an acidic zeolitic catalyst. U.S. Pat. No. 4,753,720 (Morrison) discloses a process for the isomerization of olefins in catalytically cracked gasoline at a temperature of at least 700° F. using an acidic zeolitic catalyst. None of the above references discloses the use of the present invention, combining removal of highly unsaturated compounds and an olefin isomerization step to address the problems described hereinabove.

Several methods of selectively removing small amounts of highly unsaturated hydrocarbons from a stock are known in the art. Clay treating for polymerization of small amounts of unsaturates is old and disclosed, for example, in U.S. Pat. No. 2,778,863 (Maisel). There also is a plethora of art on the selective hydrogenation of thermally cracked gasoline for diolefin reduction with a concomitant reduction in polymer and gum formation. Selective hydrogenation of pyrolysis gasoline at relatively low temperatures followed by higher-temperature hydrotreating are disclosed in U.S. Pat. Nos. 3,470,085 (Parker), 3,556,983 (Kronig et al.) and 3,702,291 (Jacquin et al.). However, it is believed that the prior art does not teach or suggest removal of highly unsaturated hydrocarbons prior to an olefin isomerization process.

U.S. Pat. No. 4,803,185 (Miller et al.) teaches the use of non-zeolitic molecular sieves in a multi-compositional catalytic cracking catalyst which effects an octane increase without the selectivity loss of the prior art. However, Miller does not suggest the present olefin isomerization process.

The prior art, therefore, contains elements of the present invention. There is no suggestion to combine the elements, however, nor of the surprising benefits that accrue in an olefin isomerization process.

SUMMARY OF THE INVENTION

Objects

It is an object of the present invention to provide an improved process for the isomerization of olefins in a feed stream containing highly unsaturated hydrocarbons. Other objectives are to improve the ratio of branched to unbranched olefins in the product, reduce the yield of by-products, and increase the life of the olefin-isomerization catalyst.

Summary

This invention is based on the discovery that olefins in a catalytically cracked gasoline stream can be isomerized effectively to increase the ratio of branched to unbranched olefins in a process which includes selective reduction of highly unsaturated hydrocarbons in the gasoline feed stream.

Embodiments

A broad embodiment of the present invention is directed to an olefin isomerization process comprising the selective reduction of highly unsaturated hydrocarbons followed by isomerization using an isomerization catalyst containing at least one medium-pore molecular sieve to increase the ratio of branched to unbranched pentenes to at least about 2.

In a preferred embodiment, the feed stream is a gasoline-range stream from catalytic cracking.

Clay treating is a preferred method of reducing the content of highly unsaturated hydrocarbons. An alternative method is selective hydrogenation of acetylenes and dienes.

Preferably, the ratio of branched to unbranched olefins in the product will be about 3 or more and the net yield of $C_4$ and lighter by-products will be less than about 0.5%. These, as well as other objects and embodiments, will become apparent from the detailed description of the invention.

DESCRIPTION OF THE PREFERRED EMBODIMENTS

To reiterate, a broad embodiment of the present invention is directed to an olefin isomerization process comprising the selective reduction of highly unsaturated hydrocarbons followed by isomerization using an isomerization catalyst containing at least one medium-pore molecular sieve to increase the ratio of branched to unbranched pentenes to at least about 2.

The feed stream to the present process contains olefins whose isomer distribution may be changed for a given carbon number by isomerization. Typically the feed stream distills substantially within the gasoline range and has been derived from the cracking of a petroleum-derived feedstock. Alternatively, the feed stream may be derived by synthesis such as the Fischer-Tropsch reaction.

The preferred feed stream is derived by the fluid catalytic cracking ("FCC") of petroleum feedstocks heavier than gasoline to produce primarily a gasoline range product. The initial boiling point of the FCC gasoline typically is from about 30° to 80° C. and the end point from 100° to 225° C. by the ASTM D-86 test. It may be advantageous in order to avoid feed prefractionation to process a full-range FCC gasoline having an end point of from 150° to 225° C., but gasolines having lower end points contain more olefins and thus will show a greater octane increase from the application of the present isomerization process. The FCC gasoline usually will contain substantially all of the pentenes produced in the FCC process, although it is within the scope of the invention that a portion of the $C_5$ fraction has been removed from the feed stream.

The olefin content of the feed stream generally is in the range of 20 to 50 mass %. Higher olefin contents usually are associated with lower FCC gasoline end points.

The feed stream to the present process may contain from 0.1 to 5 mass % of highly unsaturated hydrocarbons. Highly unsaturated hydrocarbons include acetylenes and dienes, often formed in high-temperature cracking reactions. In an olefin isomerization process, processing a feed stream containing acetylenes and dienes may require higher operating temperatures, with correspondingly less favorable equilibrium isomer distribution, and also may reduce catalyst life. It is believed that the acetylenes and dienes may form polymer or gum in an isomerization operation, resulting in fouling or coking of the catalyst. In any event, selective reduction of the acetylenes and dienes to produce a stable-olefinic stream as isomerization feed has been found to be advantageous.

Clay treating is one means of removing highly unsaturated hydrocarbons from the feed stream. The feed stream is contacted with a clay comprising principally amorphous combinations of silica and alumina such as Fuller's earth, Attapulgas clay, activated bentonite, Superfiltrol, Floridin and the like. Suitable operating conditions include a temperature of from about 150° to 400° C., a pressure of from atmospheric to about 50 atmospheres, and a liquid hourly space velocity of from about 1 to 100. The acetylenes and dienes form polymer, which may remain on the clay or be removed from the product by fractional distillation.

Alternatively, highly unsaturated hydrocarbons may be removed from the feed by selective hydrogenation. This alternative features the advantage of forming valuable olefins rather than polymer from the acetylenes and dienes, but generally is more costly than clay treating. U.S. Pat. No. 3,470,085 teaches an applicable method for removing diolefins from gasoline by selective hydrogenation, and is incorporated herein by reference thereto. Suitable operating conditions include a temperature of from about 20° to 250° C., a pressure of from about 5 atmospheres to 80 atmospheres, and a liquid hourly space velocity of from about 1 to 20. Hydrogen is supplied to the process in an amount sufficient at least to convert diolefins and acetylenes in the feed stream to olefins.

The catalyst for selective hydrogenation preferably comprises one or more metals selected from Groups VIB (6) and VIII (8-10) of the Periodic Table [see Cotton and Wilkinson, Advanced Inorganic Chemistry John Wiley & Sons (Fifth Edition, 1988)] on a refractory inorganic support. One or more of the platinum-group metals, especially palladium and platinum, are highly preferred, and nickel is an alternative metallic component of the catalyst. Alumina is an especially preferred support material.

It is within the scope of the present invention that other means known in the art of removing highly unsaturated hydrocarbons from the feed stream may be employed. U.S. Pat. No. 3,596,436, for example, teaches a process for adsorption of diolefins from a mixture also containing monoolefins and is incorporated herein by reference thereto.

The selective reduction of highly unsaturated hydrocarbons yields a stable olefinic stream as feed to an olefin-isomerization step. Preferably, the level of acetylenes and dienes in the stable olefinic stream has been reduced to about 0.1 mass % or less.

According to the process of the present invention, the stable olefinic stream is contacted with an isomerization catalyst containing at least one medium-pore molecular sieve having a butane cracking value of at least about 2 in an olefin-isomerization zone. Contacting may be effected using the catalyst in a fixed-bed system, a moving-bed system, a fluidized-bed system, or in a batch-type operation. In view of the potential attrition loss of the valuable catalyst and of the operational advantages, a fixed-bed system is preferred. The conversion zone may be in one reactor or in separate reactors with suitable means therebetween to ensure that the desired isomerization temperature is maintained at the entrance to each reactor. The reactants may contact the catalyst in the liquid phase, a mixed vapor-liquid phase, or a vapor phase. Preferably, the reactants contact the catalyst in the vapor phase. The contact may be effected in each reactor in either an upward, downward, or radial-flow manner.

The stable olefinic feed stream may contact the catalyst in the absence of hydrogen or in presence of hydrogen in a molar ratio to feed stream of from about 0.01 to 5. Hydrogen may be supplied totally from outside the isomerization process, or the outside hydrogen may be supplemented by hydrogen separated from reaction products and recycled to the charge stock. Inert diluents such as nitrogen, argon, methane, ethane and the like may be present. Although the principal isomerization reaction does not consume hydrogen, there may be net consumption of hydrogen in such side reactions as cracking and olefin saturation. In addition, hydrogen may suppress the formation of carbonaceous compounds on the catalyst and enhance catalyst stability.

It is within the scope of the invention to supply water to the olefin-isomerization zone. Water may be supplied as a liquid, along with the charge stock, or as steam, in conjunction with the hydrogen. It is believed, without limiting the invention, that water may reduce the yield of heavy byproduct and increase catalyst life through reduction of catalyst coking. The water is advantageously supplied in an amount of from about 0.01 to 5 mass % of the feed stream.

Isomerization conditions include reaction temperatures generally in the range of about 50° to 500° C., and preferably from about 100° to 350° C. Lower temperatures favor olefin branched/unbranched equilibrium ratios and mitigate paraffin equilibriation. Reactor operating pressures usually will range from atmospheric to about 50 atmospheres. The amount of catalyst in the reactors will provide an overall weight hourly space velocity of from about 0.5 to 20 $hr^{-1}$, and preferably from about 1 to 10 $hr^{-1}$.

A high yield of $C_5+$ isomerized product is a feature of the invention. The net yield of $C_4$ and lighter products is expected to be less than about 0.5 mass %.

The particular product-recovery scheme employed is not deemed to be critical to the present invention; any recovery scheme known in the art may be used. Typically, the reactor effluent will be condensed and the hydrogen, light hydrocarbons and inerts removed therefrom by flash separation. The condensed liquid product then is fractionated to remove light materials from the isomerized product.

The isomerized product contains an increased proportion relative to the feed of branched olefins, e.g., 2-methyl-1-pentene, relative to unbranched olefins, e.g., 1-hexene. The feed typically will have a ratio of branched to unbranched olefins of about 1, while the ratio in the isomerized product advantageously will be 2 or more. The branched/unbranched ratio is most reliably measured on the pentenes fraction; there are 12 branched and 5 unbranched hexene isomers, and even more isomers of the higher carbon numbers, causing measurement of the ratio to be more difficult and less dependable for these heavier olefins.

In general, the gasoline octane number (knock resistance in an internal combustion engine) is higher for branched than for unbranched olefins; for example, the American Petroleum Institute Research Project 45 shows the following unleaded octane numbers:

| | Research Octane | Motor Octane |
|---|---|---|
| 1-hexene | 76.4 | 53.4 |
| methyl 1-pentenes (average) | 95.3 | 81.2 |

Thus, the isomerized product will have a higher octane number than the isomerization feed.

FCC gasoline usually will contain a ratio of iso-to-normal paraffins that is higher than the equilibrium ratio at isomerization conditions. At an operating temperature of about 290° C. as cited in the examples, the equilibrium isopentane/normal pentane ratio is about 2 and the isohexane/normal hexane ratio is about 3.5 as calculated from free energies. If the paraffins are isomerized in the olefin-isomerization operation, therefore, the octane of the isomerized product will be lowered. An effective isomerization process will avoid equilibriation of the paraffin iso-to-normal ratio, and preferably maintain the isopentane/normal pentane ratio at about 3 or higher.

The isomerized product, or a lighter portion of the product derived by fractional distillation of the product, may be further upgraded in an etherification zone. The isomerized product is particularly suitable for etherification, as the increased branching of the olefinic portion generally results in a higher concentration of unsaturated tertiary carbon atoms which are subject to the etherification reaction. In the etherification zone, the tertiary olefin is reacted with one or more of methanol and higher alcohols at etherification conditions using an acidic catalyst to produce the respective ether product. The etherification process and catalyst are described in U.S. Pat. Nos. 4,219,678 and 4,270,929, incorporated herein by reference thereto.

The isomerization catalyst contains at least one medium-pore molecular sieve. The term "medium pore" refers to the pore size as determined by standard gravimetric adsorption techniques in the art of the referenced crystalline molecular sieve between what is recognized in the art as "large pore" and "small pore," see Flanigen et al, in a paper entitled, Aluminophosphate Molecular Sieves and the Periodic Table", published in the "New Developments in Zeolite Science and Technology" Proceedings of the 7th International Zeolite Conference, edited by Y. Murakami, A. Iijima and J. W. Ward, pages 103–112 (1986). Intermediate pore crystalline molecular sieves have pore sized between 0.4 mm and 0.8 mm, especially about 0.6 mm or 6 Å for the purposes of this invention crystalline molecular sieves having pores between about 5 and 6.5 Å are defined as "medium-pore" molecular sieves.

Preferred crystalline zeolitic aluminosilicates having medium pore sizes include the following:

ZSM-5, characterized as an MFI structure type by the IUPAC Commission on Zeolite Nomenclature. The description of ZSM-5 in U.S. Pat. Nos. 3,702,886 and Re 29,948, and particularly the x-ray diffraction pattern disclosed therein, is incorporated herein by reference thereto.

ZSM-11, characterized as an MEL structure type by IUPAC. The description of ZSM-11 in U.S. Pat. No. 3,709,979, and particularly the x-ray diffraction pattern disclosed therein, is incorporated herein by reference thereto.

ZSM-12, characterized as an MTW structure type by IUPAC. The description of ZSM-12 in U.S. Pat. No. 3,832,449, and particularly the x-ray diffraction pattern disclosed therein, is incorporated by reference thereto.

A highly preferred crystalline zeolite having a composition, expressed in terms of moles of oxides, as follows:

$$0.8\text{–}3.0M_{2/n}O:Al_2O_3:10\text{–}100SiO_2:\ 0\text{–}40H_2O$$

This zeolite is described in U.S. Pat. No. 4,257,885, incorporated herein by reference thereto.

An especially preferred component of the catalyst of the present invention is at least one non-zeolitic molecular sieve, also characterized as "NZMS" and defined in the instant invention to include molecular sieves containing framework tetrahedral units ($TO_2$) of aluminum ($AlO_2$), phosphorus ($PO_2$) and at least one additional element (EL) as a framework tetrahedral unit ($ELO_2$).

"NZMS" includes the "SAPO" molecular sieves of U.S. Pat. No. 4,440,871, "ELAPSO" molecular sieves as disclosed in U.S. Pat. No. 4,793,984 and certain "MeAPO", "FAPO", "TAPO" and "ELAPO" molecular sieves, as hereinafter described. Crystalline metal aluminophosphates (MeAPOs where "Me" is at least one of Mg, Mn, Co and Zn) are disclosed in U.S. Pat. No. 4,567,029, crystalline ferroaluminophosphates (FAPOs) are disclosed in U.S. Pat. No. 4,554,143, titanium aluminophosphates (TAPOs) are disclosed in U.S. Pat. No. 4,500,651, metal aluminophosphates wherein the metal is As, Be, B, Cr, Ga, Ge, Li or V are disclosed in U.S. Pat. No. 4,686,093, and binary metal aluminophosphates are described in Canadian Patent 1,241,943. ELAPSO molecular sieves also are disclosed in patents drawn to species thereof, including but not limited to CoAPSO as disclosed in U.S. Pat. No. 4,744,970, MnAPSO as disclosed in U.S. Pat. No. 4,793,833, CrAPSO as disclosed in U.S. Pat. No. 4,738,837, BeAPSO as disclosed in U.S. Pat. No. 4,737,353 and GaAPSO as disclosed in U.S. Pat. No. 4,735,806. The aforementioned patents are incorporated herein by reference thereto. The nomenclature employed herein to refer to the members of the aforementioned NZMSs is consistent with that employed in the aforementioned applications or patents. A particular member of a class is generally referred to as a "−n" species wherein "n" is an integer, e.g., SAPO-11, MeAPO-11 and ELAPSO-31. In the following discussion on NZMSs set forth hereinafter the mole fraction of the NZMS are defined as compositional values which are plotted in phase diagrams in each of the identified patents, published applications or copending applications.

The silicoaluminophosphate molecular sieves described in U.S. Pat. No. 4,440,871 are disclosed as microporous crystalline silicoaluminophosphates, having a three-dimensional microporous framework structure of $PO_2+$, $AlO_2-$ and $SiO_2$ tetrahedral units, and whose essential empirical chemical composition on an anhydrous basis is:

$$mR:(Si_xAl_yP_z)O_2$$

wherein "R" represents at least one organic templating agent present in the intracrystalline pore system; "m" represents the moles of "R" present per mole of $(Si_xAl_yP_z)O_2$ and has a value of from 0.02 to 0.3; "x", "y" and "z" represent, respectively, the mole fractions of silicon, aluminum and phosphorus present in the oxide moiety, said mole fractions being within the compositional area bounded by points A, B, C, D and E on the ternary diagram which is FIG. 1 of U.S. Pat. No. 4,440,871, and represent the following values for "x", "y" and "z":

| Point | Mole Fraction x | y | z |
|---|---|---|---|
| A | 0.01 | 0.47 | 0.52 |
| B | 0.94 | 0.01 | 0.05 |
| C | 0.98 | 0.01 | 0.01 |
| D | 0.39 | 0.60 | 0.01 |
| E | 0.01 | 0.60 | 0.39 |

The silicoaluminophosphates of U.S. Pat. No. 4,440,871 are generally referred to therein as "SAPO" as a class, or as "SAPO-n" wherein "n" is an integer denoting a particular SAPO such as SAPO-11, SAPO-31, SAPO-40 and SAPO-41. The especially preferred species SAPO-11 as referred to herein is a silicoaluminophosphate having a characteristic X-ray powder diffraction pattern which contains at least the d-spacings set forth below:

| SAPO-11 | | |
|---|---|---|
| 2r | d | Relative Intensity |
| 9.4–9.65 | 9.41–9.17 | m |
| 20.3–20.6 | 4.37–4.31 | m |
| 21.0–21.3 | 4.23–4.17 | vs |
| 21.1–22.35 | 4.02–3.99 | m |
| 22.5–22.9 (doublet) | 3.95–3.92 | m |
| 23.15–23.35 | 3.84–3.81 | m–s |

MeAPO molecular sieves are crystalline microporous aluminophosphates in which the substituent metal is one of a mixture of two or more divalent metals of the group magnesium, manganese, zinc and cobalt and are disclosed in U.S. Pat. No. 4,567,029. Members of this novel class of compositions have a three-dimensional microporous crystal framework structure of $MO^{-2}{}_2$, $AlO^{-}{}_2$ and $PO_2+$ tetrahedral units and have an essential empirical chemical composition, on an anhydrous basis, of:

$$mR:(M_xAl_yP_z)O_2$$

wherein "R" represents at least one organic templating agent present in the intracrystalline pore system; "m" represents the moles of "R" present per mole of $(M_xAl_yP_z)O_2$ and has a value of from zero to 0.3, the maximum value in each case depending upon the molecular dimensions of the templating agent and the available void volume of the pore system of the particular metal aluminophosphate involved; "x", "y", and "z" represent the mole fractions of the metal "M", (i.e., magnesium, manganese, zinc and cobalt), aluminum and phosphorus, respectively, present as tetrahedral oxides, said mole fractions being such that they are within the following limiting values for "x", "y", and "z":

| Point | Mole Fraction x | y | z |
|---|---|---|---|
| A | 0.01 | 0.60 | 0.39 |
| B | 0.01 | 0.39 | 0.60 |
| C | 0.35 | 0.05 | 0.60 |
| D | 0.35 | 0.60 | 0.05 |

when synthesized the minimum value of "m" in the formula above is 0.02.

An alternative component of the catalyst of the present invention is one or more of TASO, or titanium-aluminum-silicon-oxide molecular sieves having three-dimensional microporous crystal framework structures of $TiO_2$, $AlO_2$ and $SiOP_2$ tetrahedral units. TASO molecular sieves have a unit empirical formula on an anhydrous basis of:

$$mR(Ti_xAl_ySi_z)O_2$$

wherein "R" represents at least one organic templating agent present in the intracrystalline pore system; "m" represents the moles of "R" present per mole of $(Ti_x-Al_ySi_z)O_2$ and has a value of between zero and about 0.3, the maximum value in each case depending upon the molecular dimensions of the templating agent and the available void volume of pore system of the particular TASO molecular sieve; and "x", "y" and "Z" represent the mole fractions of titanium, aluminum and silicon, respectively, present as tetrahedral oxides, said mole fractions being such that they are within the following limiting values for "x", "y" and "z":

| Point | Mole Fraction | | |
|---|---|---|---|
| | x | y | z |
| A | 0.39 | 0.60 | 0.01 |
| B | 0.98 | 0.01 | 0.01 |
| C | 0.01 | 0.01 | 0.98 |
| D | 0.01 | 0.60 | 0.39 |
| E | 0.01 | 0.40 | 0.50 |
| F | 0.49 | 0.01 | 0.50 |

TASO molecular sieves are described in U.S. Pat. No. 4,707,345, incorporated herein by reference thereto.

It is within the scope of the invention that the catalyst comprises two or more medium-pore molecular sieves. Preferably the molecular sieves are as a multi-compositional, multi-phase composite having contiguous phases, a common crystal framework structure and exhibiting a distinct heterogeneity in composition, especially wherein one phase comprises a deposition substrate upon which another phase is deposited as an outer layer. Such composites are described in U.S. Pat. No. 4,861,739, incorporated herein by reference thereto.

The molecular sieve preferably is combined with a binder for convenient formation of catalyst particles. The binder should be porous, adsorptive support having a surface area of about 25 to about 500 $m^2/g$, uniform in composition and relatively refractory to the conditions utilized in the hydrocarbon conversion process. By the term "uniform in composition," it is meant that the support be unlayered, have no concentration gradients of the species inherent to its composition, and be completely homogeneous in composition. Thus, if the support is a mixture of two or more refractory materials, the relative amounts of these materials will be constant and uniform throughout the entire support. It is intended to include within the scope of the present invention carrier materials which have traditionally been utilized in hydrocarbon conversion catalysts such as: (1) refractory inorganic oxides such as alumina, titanium dioxide, zirconium dioxide, chromium oxide, zinc oxide, magnesia, thoria, boria, silica-alumina, silica-magnesia, chromia-alumina, alumina-boria, silica-zirconia, etc.; (2) ceramics, porcelain, bauxite; (3) silica or silica gel, silicon carbide, clays and silicates including those synthetically prepared and naturally occurring, which may or may not be acid treated, for example attapulgus clay, diatomaceous earth, fuller's earth, kaolin, kieselguhr, etc.; (4) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations, (5) spinels such as $MgAl_2O_4$, $FeAl_2O_4$, $ZnAl_2O_4$, $CaAl_2O_4$, and other like compounds having the formula $MO\text{-}Al_2O_3$ where M is a metal having a valence of 2; and (6) combinations of materials from one or more of these groups.

The preferred binder to effect a selective finished catalyst is a form of amorphous silica. The preferred amorphous silica is a synthetic, white, amorphous silica (silicon dioxide) powder which is classed as wet-process, hydrated silica. This type of silica is produced by a chemical reaction in a water solution, from which it is precipitated as ultra-fine, spherical particles. It is preferred that the BET surface area of the silica is in the range from about 120 to 160 $m^2/g$. A low content of sulfate salts is desired, preferably less than 0.3 wt. %. It is especially preferred that the amorphous silica binder be nonacidic, e.g., that the pH of a 5% water suspension be neutral or basic (pH about 7 or above).

The molecular sieve and binder are combined to form an extrudable dough, having the correct moisture content to allow for the formation of extrudates with acceptable integrity to withstand direct calcination. Extrudability is determined from an analysis of the moisture content of the dough, with a moisture content in the range of from 30 to 50 wt. % being preferred. Extrusion is performed in accordance with the techniques well known in the art. A multitude of different extrudate shapes are possible, including, but not limited to, cylinders, cloverleaf, dumbbell and symmetrical and asymmetrical polylobates. It is also within the scope of this invention that the extrudates may be further shaped to any desired form, such as spheres, by any means known to the art.

An optional component of the present catalyst is a platinum-group metal including one or more of platinum, palladium, rhodium, ruthenium, osmium, and iridium. The preferred platinum-group metal component is platinum. The platinum-group metal component may exist within the final catalyst composite as a compound such as an oxide, sulfide, halide, oxysulfide, etc., or as an elemental metal or in combination with one or more other ingredients of the catalyst. It is believed that the best results are obtained when substantially all the platinum-group metal component exists in a reduced state. The platinum-group metal component generally comprises from about 0.01 to about 2 mass % of the final catalytic composite, calculated on an elemental basis.

The platinum-group metal component may be incorporated into the catalyst composite in any suitable manner. The preferred method of preparing the catalyst normally involves the utilization of a water-soluble, decomposable compound of a platinum-group metal to impregnate the calcined zeolite/binder composite. For example, the platinum-group metal component may be added to the calcined hydrogel by commingling the calcined composite with an aqueous solution of chloroplatinic or chloropalladic acid.

It is within the scope of the present invention that the catalyst may contain other metal components known to modify the effect of the platinum-group metal component. Such metal modifiers may include rhenium, tin, germanium, lead, cobalt, nickel, indium, gallium, zinc, uranium, dysprosium, thallium, and mixtures thereof. Catalytically effective amounts of such metal modifiers may be incorporated into the catalyst by any means known in the art.

The catalyst of the present invention may contain a halogen component. The halogen component may be either fluorine, chlorine, bromine or iodine or mixtures thereof. Chlorine is the preferred halogen component. The halogen component is generally present in a combined state with the inorganic-oxide support. The halogen component is preferably well dispersed throughout the catalyst and may comprise from more than 0.2 to about 15 wt. %, calculated on an elemental basis, of the final catalyst.

The halogen component may be incorporated in the catalyst in any suitable manner, either during the preparation of the inorganic-oxide support or before, while or after other catalytic components are incorporated. For example, the carrier material may contain halogen and thus contribute at least some portion of the halogen content in the final catalyst. The halogen component or a portion thereof also may be added to the catalyst during the incorporation of other catalyst components into the support, for example, by using chloroplatinic acid in impregnating a platinum component. Also, the halogen component or a portion thereof may be added to the catalyst by contacting with the halogen or a compound, solution, suspension or dispersion containing the halogen before or after other catalyst components are incorporated into the support. Suitable compounds containing the halogen include acids containing the halogen, e.g., hydrochloric acid. The halogen component or a portion thereof may be incorporated by contacting the catalyst with a compound, solution, suspension or dispersion containing the halogen in a subsequent catalyst regeneration step. The catalyst composite is dried at a temperature of from about 100° to about 320° C. for a period of from about 2 to about 24 or more hours and calcined at a temperature of from 400° to about 650° C. in an air atmosphere for a period of from about 0.1 to about 10 hours until the metallic compounds present are converted substantially to the oxide form. The optional halogen component may be adjusted by including a halogen or halogen-containing compound in the air atmosphere.

The resultant calcined composite may be subjected to a substantially water-free reduction step to insure a uniform and finely divided dispersion of the optional metallic components. Preferably, substantially pure and dry hydrogen (i.e., less than 20 vol. ppm $H_2O$) is used as the reducing agent in this step. The reducing agent contacts the catalyst at conditions, including a temperature of from about 200° to about 650° C. and for a period of from about 0.5 to about 10 hours, effective to reduce substantially all of the platinum-group metal component to the metallic state.

EXAMPLES

The following examples are presented to demonstrate the present invention and to illustrate certain specific embodiments thereof. These examples should not be construed to limit the scope of the invention as set forth in the claims. There are many possible other variations, as those of ordinary skill in the art will recognize, which are within the spirit of the invention.

The examples illustrate the conversion of olefins in FCC gasoline feedstocks to more highly branched isomers. The FCC gasoline had the following characteristics:

| | | |
|---|---|---|
| ASTM D-86 end point, °C. | | 207 |
| Vol. % | paraffins | 34.8 |
| | olefins | 36.8 |
| | naphthenes | 7.9 |
| | aromatics | 20.4 |

Catalysts were evaluated using a 1¼-inch stainless-steel reactor. 20 grams of bound catalyst as 1/16" extrudates were placed in the reactor. Olefin-rich feedstock was charged to the reactor. The reaction temperature was monitored by five thermocouples in the catalyst bed and controlled by adjusting the power input to the reactor furnace. Liquid products were separated and collected. Gas output was monitored and sampled when greater than 0.1 l/hr. The liquid products were analyzed by vapor-phase chromatography.

Catalyst performance was compared by examining the ratio of branched to unbranched olefins ("B/U") in each product. ISO-to-normal paraffin ratios ("I/N") also are reported for catalysts of the invention, in order to show the extent of undesirable equilibriation. Results also were reported for product Research octane numbers ("RON") and Motor octane numbers ("MON"), knock resistance of fuels at different test conditions.

EXAMPLE I

The process of the present invention was demonstrated by effecting isomerization of olefins in gasoline from a fluid catalytic cracking unit, utilizing a synthetic crystalline zeolitic molecular sieve catalyst as described in U.S. Pat. No. 4,257,885. The specific catalyst sample used in the test had the following approximate composition in mass %:

| | |
|---|---|
| $Al_2O_3$ | 41.7 |
| $P_2O_5$ | 50.5 |
| $SiO_2$ | 7.8 |
| | 100.0 |

Tests were performed and results measured based on the feed stream described hereinabove. The feed stream was treated using Fuller's earth at a temperature of 260° C. to produce feed to the isomerization step. The clay-treated isomerization feed contacted the isomerization catalyst at the following condition:

| | |
|---|---|
| Temperature, °C. | 288° |
| WHSV, $hr^{-1}$ | 1.12 |
| Pressure, atm. | 2.9 |

Results were as follows, comparing yield branched/unbranched ratio ("B/U"), and octanes:

| | | Feed | Product |
|---|---|---|---|
| $C_5$+ yield, mass % | | 100.0 | 99.6 |
| B/U: | pentenes | 1.09 | 3.97 |
| | hexenes | 1.31 | 1.96 |
| I/N: | pentanes | 5.14 | 5.46 |
| | hexanes | 7.90 | 8.22 |
| RON clear | | 91.2 | 91.5 |
| MON clear | | 79.5 | 80.0 |

The significant isomerization of olefins thus was accomplished while avoiding reversion of paraffin iso-/normal ratios to equilibrium values.

EXAMPLE II

A control test of the prior art was carried out to demonstrate the utility of the invention. The FCC gasoline feed and the SAPO-11 catalyst were the same as used in Example I in order to provide a reliable comparison of the invention and the prior art. The untreated feedstock contacted the isomerization catalyst at the following conditions:

| | |
|---|---|
| Temperature, °C. | 288° C. |
| WHSV, $hr^{-1}$ | 1.10 |
| Pressure, atm. | 3.0 |

Results were as follows, comparing yield and branched-/unbranched ratio ("B/U").

| | Feed | Product |
|---|---|---|
| $C_5$+ yield, mass % | 100 | 100 |
| B/U: pentenes | 1.04 | 1.04 |
| hexenes | 1.31 | 1.00 |
| I/N: pentanes | 6.36 | 6.13 |
| hexanes | 8.54 | 8.44 |

The low ratio of branched to unbranched olefins in the product compared to the results presented in Example I demonstrate the benefits of the process of the invention.

EXAMPLE III

The process of the invention was demonstrated using as isomerization catalyst a preferred crystalline zeolite as described hereinabove and in U.S. Pat. No. 4,257,885. The zeolite had the following approximate composition in mass %:

| | |
|---|---|
| $Al_2O_3$ | 4.3 |
| $SiO_2$ | 95.6 |
| CaO | 0.1 |
| | 100.0 |

Tests were performed and results measured based on the feed stream described hereinabove. The feed stream was treated using Fuller's earth at a temperature of 260° C. to produce feed to the isomerization step. The clay-treated isomerization feed contacted the isomerization catalyst at the following conditions with the following results:

| | Feed | Product | |
|---|---|---|---|
| Temperature, °C. | | 262° | 286° |
| WHSV, $hr^{-1}$ | | 1.10 | 1.11 |
| Pressure, atm. | | 2.4 | 2.3 |
| $C_5$+ yield, mass % | 100.0 | 100.0 | 100.0 |
| B/U: pentenes | 1.01 | 3.95 | 4.23 |
| hexenes | 0.98 | 2.21 | 2.20 |
| I/N: pentanes | 6.68 | 6.16 | 6.27 |
| hexanes | 8.67 | 8.58 | 8.62 |
| RON clear | 91.1 | 92.6 | 92.8 |
| MON clear | 79.0 | 79.7 | 80.1 |

EXAMPLE IV

The process of the invention was demonstrated using as isomerization catalyst a titanium-aluminum-silicon-oxide (TASO) as described hereinabove and in U.S. Pat. No. 4,707,345. The catalyst had the following approximate composition in mass %:

| | |
|---|---|
| $TiO_4$ | 13.9 |
| $Al_2O_3$ | 3.6 |
| $SiO_2$ | 82.5 |
| | 100.0 |

Tests were performed and results measured based on the feed stream described hereinabove. The feed stream was treated using Fuller's earth at a temperature of 260° C. to produce feed to the isomerization step. The clay-treated isomerization feed contacted the isomerization catalyst at the following conditions with the following results:

| | Feed | Product | |
|---|---|---|---|
| Temperature, °C. | | 261° | 291° |
| WHSV, $hr^{-1}$ | | 1.14 | 1.13 |
| Pressure, atm. | | 2.7 | 2.8 |
| $C_5$+ yield, mass % | 100.0 | 100.0 | 100.0 |
| B/U: pentenes | 0.97 | 2.07 | 3.15 |
| hexenes | 0.94 | 1.78 | 2.02 |
| I/N: pentanes | 6.13 | 6.48 | 6.51 |
| hexanes | 8.71 | 5.95 | 8.92 |
| RON clear | 89.5 | — | 90.8 |
| MON clear | 78.9 | — | 80.0 |

I claim:

1. A process for the isomerization of isomerizable olefins in a feed stream consisting essentially of an olefin-containing gasoline-range stream produced by a catalytic cracking process and containing highly unsaturated hydrocarbons comprising the steps of:

(a) selectively reducing the content of highly unsaturated hydrocarbons in the feed stream to produce a stable olefinic stream, and (b) contacting the stable olefinic stream at olefin-isomerization conditions with an isomerization catalyst containing at least one medium-pore molecular sieve to produce an isomerized product having a ratio of branched to unbranched olefins of at least about 2.

2. The process of claim 1 wherein step (a) comprises clay treating of the feed stream at clay-treating conditions to polymerize highly unsaturated hydrocarbons.

3. The process of claim 2 wherein step (a) comprises a polymer-removal step.

4. The process of claim 1 wherein step (a) comprises selective hydrogenation of the highly unsaturated hydrocarbons at selective-hydrogenation conditions.

5. The process of claim 1 wherein the molecular sieve comprises at least one synthetic crystalline zeolitic molecular sieve.

6. The process of claim 1 wherein the molecular sieve comprises at least one non-zeolitic molecular sieve.

7. The process of claim 1 wherein the molecular sieve comprises at least one TASO.

8. The process of claim 1 wherein the isomerization catalyst comprises an inorganic-oxide matrix.

9. The process of claim 8 wherein the inorganic-oxide matrix comprises silica.

10. The process of claim 8 wherein the isomerization catalyst comprises a halogen component.

11. The process of claim 1 wherein the isomerization catalyst comprises at least one platinum-group metal component.

12. The process of claim 11 wherein the platinum-group metal component comprises platinum.

13. The process of claim 1 wherein the olefin-isomerization conditions comprise a pressure of from about atmospheric to 50 atmospheres, a temperature of from about 50° to 500° C., and a liquid hourly space velocity of from about 0.5 to 20.

14. The process of claim 13 wherein the temperature is from about 100° to 350° C.

15. The process of claim 1 wherein the isomerized product has a ratio of branched to unbranched olefins of at least about 3.

16. The process of claim 1 wherein the net yield of $C_4$ and lighter products is less than about 0.5 mass %.

17. A process for the isomerization of isomerizable olefins in a feed stream consisting essentially of an olefin-containing gasoline-range stream produced by a catalytic cracking process and containing highly unsaturated hydrocarbons comprising the steps of:

(a) selectively reducing the content of highly unsaturated hydrocarbons in the feed stream to produce a stable olefinic stream, and (b) contacting the stable olefinic stream at olefin-isomerization conditions with an isomerization catalyst comprising at least one medium-pore molecular sieve to produce an isomerized product having a ratio of branched to unbranched olefins of at least about 2 and a ratio of iso-to-normal pentane of at least about 3.

18. A process for the isomerization of isomerizable olefins in a feed stream consisting essentially of an olefin-containing gasoline-range stream produced by a catalytic cracking process and containing highly unsaturated hydrocarbons comprising the steps of:

(a) selectively reducing the content of highly unsaturated hydrocarbons in the feed stream to produce a stable olefinic stream, and (b) contacting the stable olefinic stream at olefin-isomerization conditions with an isomerization catalyst comprising at least one non-zeolitic molecular sieve to produce an isomerized product having a ratio of branched to unbranched olefins of at least about 2 and a ratio of iso-to-normal pentane of at least about 3.

* * * * *